US008789254B2

(12) United States Patent
Minisandram et al.

(10) Patent No.: US 8,789,254 B2
(45) Date of Patent: Jul. 29, 2014

(54) MODIFYING HOT WORKABILITY OF METAL ALLOYS VIA SURFACE COATING

(75) Inventors: Ramesh S. Minisandram, Charlotte, NC (US); Richard L. Kennedy, Monroe, NC (US); Robin M. Forbes Jones, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 90 days.

(21) Appl. No.: 13/007,692

(22) Filed: Jan. 17, 2011

(65) Prior Publication Data

US 2012/0183708 A1 Jul. 19, 2012

(51) Int. Cl.
*B23P 17/00* (2006.01)

(52) U.S. Cl.
USPC ..... 29/424

(58) Field of Classification Search
USPC ..... 29/424, 460, 458, 527.1, 527.2, 527.4; 428/34.6, 433; 72/46; 427/374.6, 190, 427/318, 292, 376.5; 156/89.28
See application file for complete search history.

(56) References Cited

U.S. PATENT DOCUMENTS

| | | | | |
|---|---|---|---|---|
| 2,191,478 | A | 2/1940 | Hopkins | |
| 2,295,702 | A | 9/1942 | Wissler | |
| 3,001,059 | A | 9/1961 | Jones | |
| 3,021,594 | A | 2/1962 | Clatot et al. | |
| 3,446,600 | A * | 5/1969 | Eckstein et al. | 422/88 |
| 3,493,713 | A | 2/1970 | Johnson | |
| 3,617,685 | A | 11/1971 | Brill-Edwards et al. | |
| 3,693,419 | A | 9/1972 | De Pierre et al. | |
| 3,814,212 | A | 6/1974 | Latos | |
| 4,055,975 | A | 11/1977 | Serfozo et al. | |
| 4,060,250 | A | 11/1977 | Davis et al. | |
| 4,744,504 | A | 5/1988 | Turner | |
| 4,780,484 | A * | 10/1988 | Schubert et al. | 521/106 |
| 4,961,991 | A | 10/1990 | Howard | |
| 5,298,095 | A | 3/1994 | Russo et al. | |
| 5,348,446 | A | 9/1994 | Lee et al. | |
| 5,525,779 | A | 6/1996 | Santella et al. | |
| 5,665,180 | A | 9/1997 | Seetharaman et al. | |
| 5,743,121 | A | 4/1998 | Miller | |
| 5,783,530 | A | 7/1998 | Foster et al. | |
| 5,788,142 | A | 8/1998 | Bigay et al. | |

(Continued)

FOREIGN PATENT DOCUMENTS

| | | |
|---|---|---|
| EP | 386515 | 2/1990 |
| EP | 0767028 | 4/1997 |

(Continued)

OTHER PUBLICATIONS

Donachie et al., Superalloys: A Technical Guide, Melting and Conversion, pp. 56-77, ASM International, 2002.

(Continued)

*Primary Examiner* — John C Hong
(74) *Attorney, Agent, or Firm* — K&L Gates LLP; John E. Grosselin, III

(57) ABSTRACT

A method of processing an alloy ingot or other alloy workpiece to reduce thermal cracking may generally comprise depositing a glass material onto at least a portion of a surface of a workpiece, and heating the glass material to form a surface coating on the workpiece that reduces heat loss from the workpiece. The present disclosure also is directed to an alloy workpieces processed according to methods described herein, and to articles of manufacture including or made from alloy workpieces made according to the methods.

39 Claims, 13 Drawing Sheets

(56) References Cited

U.S. PATENT DOCUMENTS

| | | | |
|---|---|---|---|
| 5,951,792 | A | 9/1999 | Balbach |
| 6,120,624 | A | 9/2000 | Vogt et al. |
| 6,154,959 | A | 12/2000 | Goodwater et al. |
| 6,312,022 | B1 | 11/2001 | Brophy, III et al. |
| 6,329,079 | B1 | 12/2001 | Meyer |
| 6,330,818 | B1 | 12/2001 | Jain |
| 6,418,795 | B2 | 7/2002 | Im et al. |
| 6,484,790 | B1 | 11/2002 | Myers et al. |
| 6,753,504 | B2 | 6/2004 | Keller et al. |
| 6,933,058 | B2 | 8/2005 | Darolia et al. |
| 7,000,306 | B2 | 2/2006 | Rice et al. |
| 7,108,483 | B2 | 9/2006 | Segletes et al. |
| 7,114,548 | B2 | 10/2006 | Forbes Jones |
| 7,172,820 | B2 | 2/2007 | Darolia et al. |
| 7,257,981 | B2 | 8/2007 | Natsui et al. |
| 7,264,888 | B2 | 9/2007 | Darolia et al. |
| 7,288,328 | B2 | 10/2007 | Darolia et al. |
| 7,316,057 | B2 | 1/2008 | Seth |
| 7,357,958 | B2 | 4/2008 | Darolia et al. |
| 7,516,526 | B2 | 4/2009 | Rice et al. |
| 7,722,330 | B2 | 5/2010 | Seth |
| 7,770,427 | B2 | 8/2010 | Nakahara et al. |
| 8,230,899 | B2 | 7/2012 | Minisandram |
| 2002/0019321 | A1 | 2/2002 | Balliett et al. |
| 2002/0172587 | A1 | 11/2002 | Keller et al. |
| 2004/0079453 | A1 | 4/2004 | Groh et al. |
| 2004/0105774 | A1 | 6/2004 | Del Corso et al. |
| 2005/0011070 | A1 | 1/2005 | Rice et al. |
| 2005/0061855 | A1 | 3/2005 | Rice et al. |
| 2005/0118453 | A1 | 6/2005 | Darolia et al. |
| 2005/0273994 | A1 | 12/2005 | Bergstrom et al. |
| 2006/0008352 | A1 | 1/2006 | Segletes et al. |
| 2006/0035102 | A1 | 2/2006 | Darolia et al. |
| 2006/0093752 | A1 | 5/2006 | Darolia et al. |
| 2006/0093850 | A1 | 5/2006 | Darolia et al. |
| 2006/0093851 | A1 | 5/2006 | Darolia et al. |
| 2006/0239852 | A1 | 10/2006 | Shipton et al. |
| 2011/0195269 | A1 | 8/2011 | Minisandram |
| 2011/0195270 | A1 | 8/2011 | De Souza et al. |
| 2011/0302978 | A1 | 12/2011 | Oppenheimer et al. |
| 2011/0302979 | A1 | 12/2011 | Oppenheimer et al. |
| 2012/0279678 | A1 | 11/2012 | Minisandram |

FOREIGN PATENT DOCUMENTS

| | | | |
|---|---|---|---|
| EP | 0969114 | | 1/2000 |
| EP | 1197570 | | 4/2002 |
| GB | 684013 | A | 12/1952 |
| GB | 1202080 | A | 8/1970 |
| GB | 1207675 | A | 10/1970 |
| GB | 2190319 | A | 11/1987 |
| GB | 2262540 | A | 6/1993 |
| JP | 54-52656 | A | 4/1979 |
| JP | 6-63743 | A | 3/1994 |
| JP | 11-320073 | | 11/1999 |
| JP | 2000 312905 | A | 11/2000 |
| JP | 2003-239025 | A | 8/2003 |
| SU | 1761364 | A1 | 9/1992 |
| WO | WO 94/13849 | A1 | 6/1994 |
| WO | WO 95/35396 | | 12/1995 |
| WO | WO 98/05463 | A1 | 2/1998 |
| WO | WO 99/02743 | A1 | 1/1999 |
| WO | WO 01/12381 | | 2/2001 |

OTHER PUBLICATIONS

Paton et al., ESS LM as a way for heavy ingot manufacturing, LMPC, 2007.

ASTM E2465—06 (2006): Standard Test Method for Analysis of Ni-Base Alloys by X-ray Fluorescence Spectrometry.

ASTM E1019—08 (2008): Standard Test Methods for Determination of Carbon, Sulfur, Nitrogen, and Oxygen in Steel, Iron, Nickel, and Cobalt Alloys by Various Combustion and Fusion Techniques.

Santella, An overview of the welding of $Ni_3Al$ and $Fe_3Al$ alloys, ASME and ASM Materials Conference, Dec. 31, 1996.

Levin et al., Robotic weld overlay coatings for erosion control, Quarterly Technical Progress Report for U.S. DOE Grant No. DE-FG22-92PS92542, Lehigh University, Energy Research Center, Apr. 25, 1995.

Maziasz et al., Overview of the development of FeAl intermetallic alloys, Proceedings of the 2d International Conference on Heat-Resistant Materials, Sep. 1, 1995.

Ito et al., Blast erosion properties of overlay weld metal, Welding International, 5:3, 1991, pp. 192-197.

Horn et al., Auftragschweiβungen mit Hastelloy alloy B-42 (Overlay welding with Hastelloy B-42), Materials and Corrosion, 43:8, 1992, pp. 381-387.

Tillack, Weld fabrication of nickel-containing materials, Practical handbook of stainless steels & nickel alloys, Lamb ed., CASTI Publishing Inc., ASM International, Aug. 1999, pp. 325-370.

Atlan et al., Metal Forming: Fundamentals and Applications, Ch. 6. Friction in Metal Forming, ASM: 1993.

U.S. Appl. No. 12/814,591, filed Jun. 14, 2010.

U.S. Appl. No. 13/833,043, filed Mar. 15, 2013.

Insulating Method Improves Superalloy Forging, Baosteel Technical Research, Apr. 23, 2012, vol. 5, No. 4, 2 pages.

ITC-100, ITC-200, ITC-213 Ceramic Coatings, BCS International Technical Ceramics Coatings, http://budgetcastingsupply.com/ITC.php, Feb. 2013, 3 pages.

Carbon Steel, E-Z LOK, AISI 12L14 Steel, cold drawn, 19-38 mm round, Aug. 5, 2013, http://www.ezlok.com/TechnicalInfo/MPCarbonSteel.html, 1 page.

Alloy 309/309S, Specification Sheet: Alloy 309, Sandmeyer Steel Company, Aug. 5, 2013, http://www.sandmeyersteel.com/309-309S.html, 4 pages.

Shivpuri, R. and S. Kini, Lubricants and Their Applications in Forging, ASM Handbook, vol. 14A, Metalworking: Bulk Forming, Semiatin, S.L., ed., 2005, ASM International, Ohio, US, p. 84.

Schey et al., Laboratory Testing of Glass Lubricants, Lubrication Engineering/Tribology and Lubrication Technology, Society of Tribologists and Lubrication Engineers, US, vol. 30, No. 10, Oct. 1, 1974, pp. 489-497.

McGraw Hill Encyclopedia of Science and Technology, 1992, McGraw Hill Inc., vol. 11, pp. 32-33.

Chesney, Peter, A New Spray Coating Process for Manufacture of Stainless Steel Clad Construction Steel with Resistance to Corrosion by De-icing Salts & Seawater, Spray Forming International, Cayce, South Carolina, USA, Thermal Spray 2003: Advancing the Science and Applying the Technology, ASM International, 2003, 5 pages.

Anchor Industrial Sales, Inc. Product Data Sheets, Style #412 Fiberglass cloth, Style #412IB Fiberglass Mats, 2008, 2 pages.

* cited by examiner

MODIFYING HOT WORKABILITY OF METAL ALLOYS VIA SURFACE COATING

TECHNICAL FIELD

The present disclosure is directed to alloy ingots and other alloy workpieces, methods for processing the same and, in particular, methods for improving the hot workability of alloy ingots and other alloy workpieces by providing a surface coating thereon.

BACKGROUND

Various alloys may be characterized as being "crack sensitive". Ingots and other workpieces composed of crack sensitive alloys may form cracks along their surfaces and/or edges during hot working operations. Forming articles from crack sensitive alloys may be problematic because, for example, cracks formed during forging or other hot working operations may need to be ground off or otherwise removed, increasing production time and expense, and reducing yield.

During certain hot working operations, such as forging and extrusion, dies apply a force to an alloy workpiece to deform the workpiece. The interaction between the die's surfaces and the alloy workpiece's surfaces may involve heat transfer, friction, and wear. One conventional technique for reducing surface and edge cracking during hot working is to enclose the alloy workpiece in a metal alloy can before hot working. With a cylindrical workpiece, for example, the inside diameter of the alloy can may be slightly larger than the outside diameter of the workpiece. The alloy workpiece may be inserted into the alloy can such that the alloy can loosely surrounds the workpiece, and the dies contact the outer surfaces of the alloy can. The alloy can thermally insulates and mechanically protects the enclosed workpiece, thereby eliminating or reducing the incidence of crack formation on the workpiece. The alloy can thermally insulates the alloy workpiece by action of the air gaps between the workpiece and the alloy can's inner surfaces and also by directly inhibiting the alloy workpiece from radiating heat to the environment.

An alloy workpiece canning operation may result in various disadvantages. For example, mechanical contact between dies and the alloy can's outer surfaces may break apart the alloy can. In one specific case, during upset-and-draw forging of a canned workpiece, the alloy can may break apart during the draw operation. In such a case, the alloy workpiece may need to be re-canned between each upset-and-draw cycle of a multiple upset-and-draw forging operation, which increases process complexity and expense. Further, the alloy can may impair an operator from visually monitoring the surface of a canned alloy workpiece for cracks and other work-induced defects.

Given the foregoing drawbacks, it would be advantageous to provide a more efficient and/or more cost-effective method of hot working crack sensitive alloys. More generally, it would be advantageous to provide a method for improving the hot workability of alloy ingots and other alloy workpieces.

SUMMARY

According to certain non-limiting embodiments, methods for processing alloy ingots and other alloy workpieces are described.

Various non-limiting embodiments disclosed herein are directed to methods for improving the hot workability of alloy workpieces by providing a surface coating thereon. In one non-limiting embodiment according to the present disclosure, a method of processing an alloy workpiece includes: depositing a glass material onto at least a portion of an alloy workpiece; and heating the glass material to form a surface coating on the alloy workpiece that reduces heat loss from the alloy workpiece. In various non-limiting embodiments of the method, the glass material may be selected from a glass fabric, a glass particle, and a glass tape. In various non-limiting embodiments, depositing the glass material onto at least a portion of the workpiece may include at least one of disposing, spraying, painting, sprinkling, rolling, dipping, wrapping, and taping. In various non-limiting embodiments, heating the glass material includes heating the glass material to a temperature from 1000° F. to 2200° F. In various non-limiting embodiments, the workpiece comprises a material selected from a nickel base alloy, a nickel base superalloy, an iron base alloy, a nickel-iron base alloy, a titanium base alloy, a titanium-nickel base alloy, and a cobalt base alloy. In various non-limiting embodiments of the method, the workpiece may comprise or be selected from an ingot, a billet, a bar, a plate, a tube, a sintered pre-form, and the like. In various non-limiting embodiments of the method, the method further includes, subsequent to heating the glass material, one or more steps selected from: applying a force with at least one of a die and a roll to the workpiece to deform the workpiece; hot working the workpiece, wherein hot working comprises at least one of forging and extruding; cooling the workpiece; removing at least a portion of the surface coating from the workpiece by at least one of shot blasting, grinding, peeling, and turning; and any combination thereof.

In an additional non-limiting embodiment according to the present disclosure, a method of hot working a workpiece includes: disposing a fiberglass blanket onto at least a portion of a surface of an alloy workpiece; heating the fiberglass blanket to form a surface coating on the workpiece; applying force with at least one of a die and a roll to the workpiece to deform the workpiece, wherein the at least one of the die and the roll contacts the surface coating on a surface of the workpiece; and removing at least a portion of the surface coating from the workpiece. In various non-limiting embodiments, at least one of the die and the roll contacts at least one remnant of the surface coating on a surface of the workpiece. In various non-limiting embodiments of the method, the workpiece may comprise or be selected from an ingot, a billet, a bar, a plate, a tube, a sintered pre-form, and the like.

Further non-limiting embodiments according to the present disclosure are directed to alloy workpieces made or processed according to any of the methods of the present disclosure.

Yet further non-limiting embodiments according to the present disclosure are directed to articles of manufacture made from or including alloy workpieces made or processed according to any of the methods of the present disclosure. Such article of manufacture include, for example, jet engine components, land based turbine components, valves, engine components, shafts, and fasteners.

DESCRIPTION OF THE DRAWING FIGURES

The various non-limiting embodiments described herein may be better understood by considering the following description in conjunction with the accompanying drawing figures.

DESCRIPTION OF CERTAIN NON-LIMITING EMBODIMENTS

Figure 1:
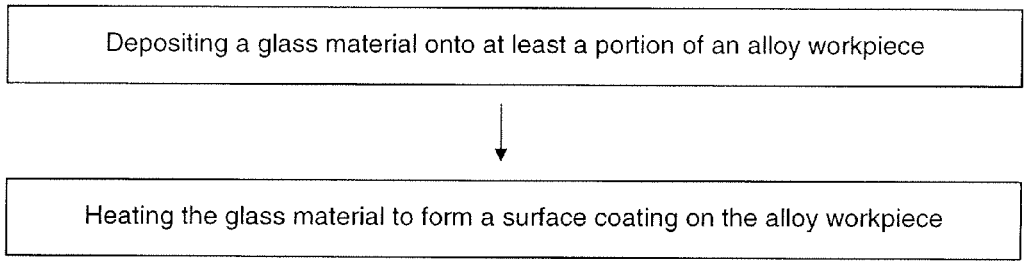
FIG. 1 is a flow diagram according to certain non-limiting embodiments of a method disclosed herein.

As generally used herein, the terms "consisting essentially of" and "consisting of" are embodied in the term "comprising".

As generally used herein, the articles "one", "a", "an", and "the" refer to "at least one" or "one or more", unless otherwise indicated.

As generally used herein, the terms "including" and "having" mean "comprising".

As generally used herein, the term "softening point" refers to the minimum temperature at which a particular glass material no longer behaves as a rigid solid and begins to sag under its own weight.

As generally used herein, the term "about" refers to an acceptable degree of error for the quantity measured, given the nature or precision of the measurement. Typical exemplary degrees of error may be within 20%, within 10%, or within 5% of a given value or range of values.

All numerical quantities stated herein are to be understood as being modified in all instances by the term "about" unless otherwise indicated. The numerical quantities disclosed herein are approximate and each numerical value is intended to mean both the recited value and a functionally equivalent range surrounding that value. At the very least, and not as an attempt to limit the application of the doctrine of equivalents to the scope of the claims, each numerical value should at least be construed in light of the number of reported significant digits and by applying ordinary rounding techniques. Notwithstanding the approximations of numerical quantities stated herein, the numerical quantities described in specific examples of actual measured values are reported as precisely as possible.

All numerical ranges stated herein include all sub-ranges subsumed therein. For example, ranges of "1 to 10" and "between 1 and 10" are intended to include all sub-ranges between and including the recited minimum value of 1 and the recited maximum value of 10. Any maximum numerical limitation recited herein is intended to include all lower numerical limitations. Any minimum numerical limitation recited herein is intended to include all higher numerical limitations.

In the following description, certain details are set forth to provide a thorough understanding of various non-limiting embodiments of the articles and methods described herein. One of ordinary skill in the art will understand that the non-limiting embodiments described herein may be practiced without these details. In other instances, well-known structures and methods associated with the articles and methods may not be shown or described in detail to avoid unnecessarily obscuring descriptions of the non-limiting embodiments described herein.

This disclosure describes various features, aspects, and advantages of various non-limiting embodiments of articles and methods. It is understood, however, that this disclosure embraces numerous alternative embodiments that may be accomplished by combining any of the various features, aspects, and advantages of the various non-limiting embodiments described herein in any combination or sub-combination that one of ordinary skill in the art may find useful.

During hot working operations, such as, for example, forging operations and extrusion operations, a force may be applied to an alloy ingot or other alloy workpiece at a temperature greater than ambient temperature, such as above the recrystallization temperature of the workpiece, to plastically deform the workpiece. The temperature of an alloy ingot or other alloy workpiece undergoing the working operation may be greater than the temperature of the dies or other structures used to mechanically apply force to the surfaces of the workpiece. The workpiece may form temperature gradients due to cooling of its surface by heat loss to ambient air and the thermal gradient off-set between its surfaces and the contacting dies or other structures. The temperature gradients may contribute to surface cracking of the workpiece during hot working. Surface cracking is especially problematic in situations in which the alloy ingots or other alloy workpieces are formed from crack sensitive alloys.

According to certain non-limiting embodiments, the alloy workpiece may comprise a crack sensitive alloy. For example, various nickel base alloys, iron base alloys, nickel-iron base alloys, titanium base alloys, titanium-nickel base alloys, cobalt base alloys, and superalloys, such as nickel base superalloys, may be crack sensitive, especially during hot working operations. An alloy ingot or other alloy workpiece may be formed from such crack sensitive alloys and superalloys. For example, a crack sensitive alloy workpiece may be formed from alloys or superalloys selected from, but not limited to, Alloy 718 (UNS No. N07718), Alloy 720 (UNS No. N07720), Rene 41™ alloy (UNS No. N07041), Rene 88™ alloy, Waspaloy® alloy (UNS No. N07001), and Inconel® 100 alloy. Although the methods described herein are advantageous for use in connection with crack sensitive alloys, it will be understood that the methods also are generally applicable to any alloy, including, for example, alloys characterized by a relatively low ductility at hot working temperatures, alloys hot worked at temperatures from 1000° F. to 2200° F., and alloys not generally prone to cracking. As used herein, the term "alloy" includes conventional alloys and superalloys. As is understood by those having ordinary skill in the art, superalloys exhibit relatively good surface stability, corrosion and oxidation resistance, high strength, and high creep resistance at high temperatures. In various non-limiting embodiments, the alloy workpiece may comprise or be selected from an ingot, a billet, a bar, a plate, a tube, a sintered pre-form, and the like.

An alloy ingot or other alloy workpiece may be formed using, for example, conventional metallurgy techniques or powder metallurgy techniques. For example, in various non-limiting embodiments, an alloy ingot or other alloy workpiece may be formed by a combination of vacuum induction melting (VIM) and vacuum arc remelting (VAR), known as a VIM-VAR operation. In various non-limiting embodiments, an alloy workpiece may be formed by a triple melting technique, in which an electroslag remelting (ESR) operation is performed intermediate a VIM operation and a VAR operation, providing a VIM-ESR-VAR (i.e., triple melt) sequence. In other non-limiting embodiments, an alloy workpiece may be formed using a powder metallurgy operation involving atomization of molten alloy and the collection and consolidation of the resulting metallurgical powders into an alloy workpiece.

In certain non-limiting embodiments, an alloy ingot or other alloy workpiece may be formed using a spray forming operation. For example, VIM may be used to prepare a base alloy composition from a feedstock. An ESR operation may optionally be used after VIM. Molten alloy may be extracted from a VIM or ESR melt pool and atomized to form molten droplets. The molten alloy may be extracted from a melt pool using a cold wall induction guide (CIG), for example. The molten alloy droplets may be deposited using a spray forming operation to form a solidified alloy workpiece.

In certain non-limiting embodiments, an alloy ingot or other alloy workpiece may be formed using hot isostatic pressing (HIP). HIP generally refers to the isostatic application of a high pressure and high temperature gas, such as, for example, argon, to compact and consolidate powder material into a monolithic preform. The powder may be separated from the high pressure and high temperature gas by a hermetically sealed container, which functions as a pressure barrier between the gas and the powder being compacted and consolidated. The hermetically sealed container may plastically deform to compact the powder, and the elevated temperatures may effectively sinter the individual powder particles together to form a monolithic preform. A uniform compaction pressure may be applied throughout the powder, and a homogeneous density distribution may be achieved in the preform. For example, a near-equiatomic nickel-titanium alloy powder may be loaded into a metallic container, such as, for example, a steel can, and outgassed to remove adsorbed moisture and entrapped gas. The container containing the near-equiatomic nickel-titanium alloy powder may be hermetically sealed under vacuum, such as, for example, by welding. The sealed container may then be HIP'ed at a temperature and under a pressure sufficient to achieve full densification of the nickel-titanium alloy powder in the container, thereby forming a fully-densified near-equiatomic nickel-titanium alloy preform.

According to certain non-limiting embodiments, a method of processing an alloy ingot or other alloy workpiece may generally comprise depositing an inorganic material onto at least a portion of an alloy workpiece and heating the inorganic material to form a surface coating on the workpiece that reduces heat loss from the workpiece. The inorganic material may comprise one or more of a thermally insulating material comprising, for example, a material selected from a fiber, a particle, and a tape. The inorganic material may comprise, for example, one or more of aluminum oxide, calcium oxide, magnesium oxide, silicon dioxide, zirconium oxide, sodium oxide, lithium oxide, potassium oxide, boron oxide, and the like. The inorganic material may have a melting point or softening point of 500° F. or higher, such as, for example, 500° F. to 2500° F. and 1000° F. to 2200° F. The method may comprise, for example, depositing the inorganic material onto at least a portion of the surface of the alloy workpiece and heating the inorganic material to form a surface coating on the workpiece and reduce heat loss from the workpiece. In various non-limiting embodiments, heating the inorganic material includes heating the inorganic material to a forging temperature, such as 1000° F. to 2200° F. The composition and form of the inorganic material may be selected to form a viscous surface coating at the forging temperature. The surface coating may adhere to the surface of the alloy workpiece. The surface coating may be characterized as an adherent surface coating. In addition to eliminating or reducing surface cracking, the surface coating according to the present disclosure also may lubricate surfaces of the alloy ingot or other alloy workpiece during hot working operations.

Referring to FIG. 1, a non-limiting embodiment of a method of processing an alloy workpiece that reduces thermal cracking according to the present disclosure may generally comprise depositing an inorganic glass material onto a portion of an alloy ingot or other alloy workpiece and heating the glass material to form a surface coating on the workpiece and reduce heat loss from the workpiece. The glass material may comprise a thermally insulating material comprising one or more of a glass fiber, a glass particle, and a glass tape. The glass material provided on the workpiece may form a viscous surface coating on the workpiece when the glass material is heated to a suitable temperature. The composition and form of the glass material may be selected to form a viscous surface coating at a forging temperature. The glass material surface coating may adhere to the surface of the workpiece and be retained on the surface up to and during hot working. The glass material surface coating may be characterized as an adherent surface coating. The glass material surface coating provided by heating the glass material may reduce heat loss from the alloy workpiece and eliminate or reduce the incidence of surface cracking resulting from forging, extrusion, or otherwise working the alloy workpiece relative to an otherwise identical alloy workpiece lacking such a surface coating. In addition to eliminating or reducing surface cracking, the glass material surface coating according to the present disclosure also may lubricate surfaces of the alloy workpiece during hot working operations.

In certain non-limiting embodiments, the inorganic fibers may comprise glass fibers. The glass fibers may comprise continuous fibers and/or discontinuous fibers. Discontinuous fibers may be made, for example, by cutting or chopping continuous fibers. The glass fibers may comprise, for example, one or more of $SiO_2$, $Al_2O_3$, and MgO. The glass fibers may comprise, for example, magnesium aluminosilicate fibers. The glass fibers may comprise, for example, magnesium aluminosilicate fibers selected from the group consisting of E-glass fibers, S-glass-fibers, S2-glass fibers, and R-glass fibers. E-glass fibers may comprise one or more of $SiO_2$, $Al_2O_3$, $B_2O_3$, CaO, MgO, and other oxides. S-glass fibers and S2-glass fibers may comprise one or more of $SiO_2$, $Al_2O_3$, MgO. R-glass fibers may comprise one or more of $SiO_2$, $Al_2O_3$, CaO, and MgO. In certain non-limiting embodiments, the inorganic fibers may comprise refractory ceramic fibers. The refractory ceramic fibers may be amorphous and comprise one or more of $SiO_2$, $Al_2O_3$, and $ZrO_2$.

According to certain non-limiting embodiments, a plurality of the glass fibers may comprise one or more of a bundle, a strip or tow, a fabric, and a board. As generally used herein the term "fabric" refers to materials that may be woven, knitted, felted, fused, or non-woven materials, or that otherwise are constructed of fibers. The fabric may comprise a binder to hold the plurality of fibers together. In certain non-limiting embodiments, the fabric may comprise a yarn, a blanket, a mat, a paper, a felt, and the like. In certain non-limiting embodiments, the glass fibers may comprise a glass blanket. The glass blanket may comprise, for example, E-glass fibers. Exemplary glass blankets comprising E-glass fibers useful in embodiments according to the present disclosure include, but are not limited to, fibers commercially available from Anchor Industrial Sales, Inc. (Kernersville, N.C.) under the trade designation "Style 412" and "Style 412B" having a thickness of 0.062 inches, E-glass fibers having a weight of 24 oz./yd$^2$, and a temperature rating of 1000° F. The glass fabric may comprise, for example, a fiberglass blanket, such as, for example, an E-glass blanket. The fabric may have any suitable width and length to cover at least a portion of the workpiece. The width and length of the fabric may vary according to the size and/or shape of the workpiece. The thicknesses of the fabric may vary according to the thermal conductivity of the fabric. In certain non-limiting embodiments, the fabric may have a thickness from 1-25 mm, such as 5-20 mm or 8-16 mm.

According to certain non-limiting embodiments, the inorganic particles may comprise glass particles. The glass particles may be referred to as "frits" or "fillers". The glass particles may comprise, for example, one or more of aluminum oxide, calcium oxide, magnesium oxide, silicon dioxide, zirconium oxide, sodium and sodium oxide, lithium oxide, potassium oxide, boron oxide, and the like. In certain non-limiting embodiments, the glass particles, for example, may be free from lead or comprise only trace levels of lead. In certain embodiments, the glass particles may have a metal hot-working range of 1400-2300° F., such as, for example, 1400-1850° F., 1850-2050° F., 1850-2100° F., or 1900-2300° F. Exemplary glass particles useful in embodiments according to the present disclosure include materials commercially available from Advance Technical Products (Cincinnati, Ohio) under the trade designations "Oxylub-327", "Oxylub-811", "Oxylub-709", and "Oxylub-921".

According to certain non-limiting embodiments, the inorganic tape may comprise a glass tape. In certain embodiments, the glass tape may comprise a glass backing and an adhesive. The glass backing may comprise, for example, one or more of aluminum oxide, calcium oxide, magnesium oxide, silicon dioxide, zirconium oxide, sodium and sodium oxide, lithium oxide, potassium oxide, boron oxide, and the like. The glass backing may comprise a glass fiber, such as a glass yarn, a glass fabric, and a glass cloth. The glass backing may comprise a glass filament. In various non-limiting embodiments, the glass tape may comprise a fiberglass filament reinforced packing tape. In various non-limiting embodiments, the glass tape may comprise an adhesive tape including a glass cloth backing or a tape impregnated with glass yarn or filament. In various non-limiting embodiments, the glass tape may comprise a polypropylene backing reinforced with continuous glass yarn. In various non-limiting embodiments, the glass tape may have characteristics including: an adhesion to steel of about 55 oz./in. width (60 N/100 mm width) according to ASTM Test Method D-3330; a tensile strength of about 300 lbs./in. width (5250 N/100 mm width) according to ASTM Test Method D-3759; an elongation at break of about 4.5% according to ASTM Test Method D-3759; and/or a total thickness of about 6.0 mil (0.15 mm) according to ASTM Test Method D-3652. Exemplary glass tapes useful in embodiments according to the present disclosure are commercially available from 3M Company (St. Paul, Minn.) under the trade designation SCOTCH® Filament Tape 893.

According to certain non-limiting embodiments, a method of processing an alloy ingot or other alloy workpiece in a way that reduces thermal cracking during hot working may generally comprise disposing a glass fabric onto at least a portion of a surface of the workpiece. In certain non-limiting embodiments, the fabric may be disposed onto a substantial portion of the surface of the workpiece. The surface of a alloy workpiece may comprise, for example, a circumferential surface and two lateral surfaces disposed at each end of the circumferential surface. In certain non-limiting embodiments, the fabric may be disposed onto a substantial portion of a circumferential surface of a cylindrical alloy workpiece. In certain non-limiting embodiments, the fabric may be disposed onto the circumferential surface of the cylindrical workpiece and at least one lateral surface of the cylindrical workpiece. In at least one non-limiting embodiment, a glass blanket may be disposed onto at least a portion of a circumferential surface of a cylindrical alloy workpiece and at least one lateral surface of the cylindrical workpiece. In certain non-limiting embodiments, more than one glass fabric, such as two, three, or more, may each be disposed onto at least a portion of a surface of a cylindrical workpiece and/or at least one lateral surface of the cylindrical workpiece. The fabric may be disposed by transversely wrapping the fabric around the circumferential surface of the workpiece, for example. A person having ordinary skill in the art will understand that in certain non-limiting embodiments the glass fabric may be secured to the workpiece using adhesives and/or mechanical fasteners such as, for example, glass tape and bale wire.

In certain non-limiting embodiments, a method of processing an alloy ingot or other alloy workpiece so as to reduce thermal cracking during hot working may comprise repeating the step of disposing a glass fabric onto at least a portion of the surface of the workpiece. For example, the fabric may be wrapped around the workpiece at least one time, two times, three times, four times, or more than four times. In certain non-limiting embodiments, the fabric may be wrapped around the workpiece until a predetermined thickness is achieved. Alternatively, more than one glass fabric may be disposed onto at least a portion of a circumferential surface of a cylindrical workpiece and at least one of each lateral surface of the cylindrical workpiece until a predetermined thickness is achieved. For example, the predetermined thickness may be from 1 mm to 50 mm, such as 10 mm to 40 mm. In at least one non-limiting embodiment, the method may comprise disposing a first glass fabric onto at least a portion of the surface of the workpiece and a second glass fabric onto at least one of the first glass fabric and at least a portion of the surface of the workpiece. The first glass fabric and the second glass fabric may comprise the same or different inorganic materials. For example, the first glass fabric may comprise a first E-glass blanket and the second glass fabric may comprise a second E-glass fabric. In one non-limiting embodiment, the first glass fabric may comprise an E-glass blanket and the second glass fabric may comprise a ceramic blanket, such as, for example, a KAOWOOL blanket, which is a material produced from alumina-silica fire clay.

According to certain non-limiting embodiments, a method of processing a workpiece to reduce thermal cracking may generally comprise depositing glass particles onto at least a portion of the surface of the workpiece. In certain non-limiting embodiments, the particles may be deposited onto a substantial portion of the surface of the workpiece. In certain non-limiting embodiments, the particles may be deposited onto the circumferential surface of a cylindrical workpiece and/or at least one lateral surface of the cylindrical workpiece. Depositing the particles onto a surface of the workpiece may comprise, for example, one or more of rolling, dipping, spraying, brushing, and sprinkling. The method may comprise heating the workpiece to a predetermined temperature prior to depositing the particles. For example, a workpiece may be heated to a forging temperature, such as 1000° F. to 2000° F., and 1500° F., and rolled in a bed of glass particles to deposit the glass particles on a surface of the workpiece.

Figure 13:
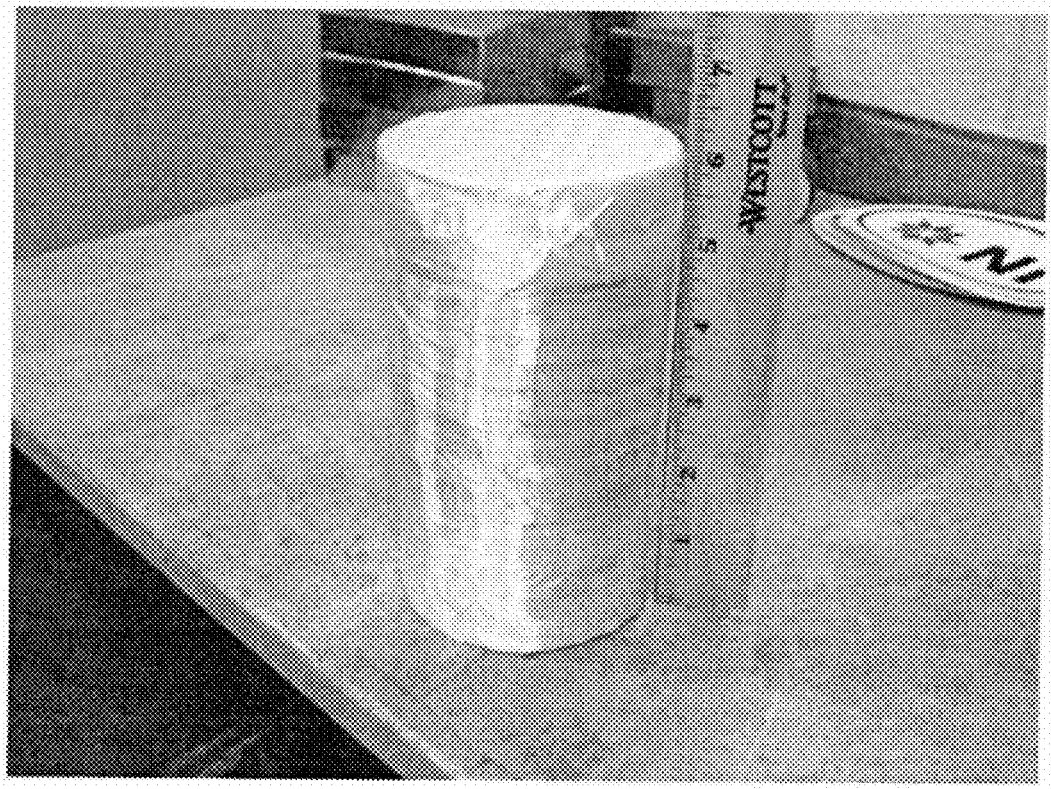
FIG. 13 is a photograph of an alloy workpiece comprising a glass tape disposed thereon according to a non-limiting embodiment disclosed herein.

According to certain non-limiting embodiments, a method of processing an alloy ingot or other alloy workpiece to reduce thermal cracking may generally comprise disposing a glass tape onto at least a portion of the surface of the workpiece. In certain non-limiting embodiments, the tape may be disposed onto a substantial portion of the surface of the workpiece. In certain non-limiting embodiments, the tape may be disposed onto a circumferential surface of a cylindrical workpiece and/or at least one lateral surface of the workpiece. Disposing the tape onto a surface of the workpiece may comprise, for example, one or more of wrapping and taping. In various non-limiting embodiments, for example, the tape may be disposed by transversely wrapping the tape around the circumferential surface of the workpiece. In certain non-limiting embodiments, the tape may be disposed onto a surface by adhering the tape onto the surface of the workpiece. In certain non-limiting embodiments, the tape may be disposed onto at least a portion of a surface of a cylindrical alloy workpiece and/or at least a portion of a glass blanket. FIG. 13, for example, is a photograph of an alloy workpiece in the form of an alloy ingot, and which includes a glass tape disposed on the circumferential surface of the workpiece and on the opposed ends or faces of the workpiece.

In certain non-limiting embodiments, a method of processing an alloy ingot or other alloy workpiece to reduce thermal cracking may comprise repeating one or more times the step of disposing a glass tape onto at least a portion of the surface of the workpiece. For example, the tape may be wrapped around the workpiece at least one time, two times, three times, four times, or more than four times. In at least one non-limiting embodiment, the method may comprise wrapping a first glass tape onto at least a portion of a surface of the workpiece and wrapping a second glass tape onto at least one of the first glass tape and at least a portion of an un-taped surface of the workpiece. In at least one non-limiting embodiment, the method may comprise taping a first glass tape to at least a portion of the surface of the workpiece and a second glass tape to at least one of the first glass tape and at least a portion of the un-taped surface of the workpiece. The first glass tape and the second glass tape may comprise the same or different inorganic materials. In certain non-limiting embodiments, the tape may be disposed on the alloy workpiece until a predetermined thickness is achieved. Alternatively, more than one glass tape may be disposed onto at least a portion of a circumferential surface of a cylindrical alloy ingot or other alloy workpiece and at least one of each lateral surface of the cylindrical workpiece until a predetermined thickness is achieved. The predetermined thickness may be, for example, from less than 1 mm to 50 mm, such as 10 mm to 40 mm.

According to certain non-limiting embodiments, the glass material provided on the alloy workpiece may form a viscous surface coating on the workpiece when the glass material is heated. The workpiece comprising the glass material thereon may be heated in a furnace. The composition of the glass material may be selected to form a viscous surface coating at the forging temperature. For example, the oxides comprising the glass material may be selected to provide a glass material having a melting point or softening point at a predetermined temperature, such as a forging temperature. In another example, the form of the glass material, i.e., a fiber, a particle, a tape, and any combinations thereof, may be selected to form a viscous surface coating at a predetermined temperature, such as, a forging temperature. A glass fabric provided on a surface of the workpiece may form a viscous surface coating on the workpiece when the glass material is heated, for example, in a furnace at a temperature from 1900° F. to 2100° F. Glass particles provided on a surface of the workpiece may form a viscous surface coating on the workpiece when the glass material is heated, for example, in a furnace at a temperature from 1450° F. to 1550° F. A glass tape provided on a surface of the workpiece may form a viscous surface coating on the workpiece when the glass material is heated, for example, in a furnace at a temperature from 1900° F. to 2100° F.

According to certain non-limiting embodiments, a surface coating provided on a surface of an alloy ingot or other alloy workpiece may be characterized as an adherent surface coating. The viscous surface coating may form an adherent surface coating when the surface coating is cooled. For example, the viscous surface coating may form an adherent surface coating when the workpiece comprising the surface coating is removed from the furnace. A surface coating may be characterized as being "adherent" when the surface coating does not immediately flow off of a workpiece surface. For example, in various non-limiting embodiments, a surface coating may be considered "adherent" when the coating does not immediately flow off the surface when the alloy ingot or other alloy workpiece is removed from the furnace. In another example, in various non-limiting embodiments, a surface coating on a circumferential surface of an alloy workpiece having a longitudinal axis and a circumferential surface may be considered "adherent" when the coating does not immediately flow off the circumferential surface when the workpiece is disposed so that the longitudinal axis is vertically oriented, such as, for example, at 45° to 135° relative to a horizontal surface. A surface coating may be characterized as a "non-adherent" surface coating when the surface coating immediately flows off of the surface of the workpiece when the workpiece is removed from the furnace.

The temperature range over which alloys may be hot worked may take into account the temperature at which cracks initiate in the alloy and the composition and form of the inorganic material. At a given starting temperature for a hot working operation, some alloys may be effectively hot worked over a larger temperature range than other alloys because of differences in the temperature at which cracks initiate in the alloy. For alloys having a relatively small hot working temperature range (i.e., the difference between the lowest temperature at which the alloy may be hot worked and the temperature at which cracks initiate), the thickness of the inorganic material may be relatively greater to inhibit or prevent the underlying workpiece from cooling to a brittle temperature range in which cracks initiate. Likewise, for alloys having a relatively large hot working temperature range, the thickness of the inorganic material may be relatively smaller to inhibit or prevent the underlying alloy ingot or other alloy workpiece from cooling to a brittle temperature range in which cracks initiate.

According to certain non-limiting embodiments, a method of processing an alloy ingot or other alloy workpiece to reduce thermal cracking may generally comprise heating the inorganic material to form a surface coating on the workpiece. Heating the inorganic material may comprise, for example, heating the inorganic material to a temperature from 500-2500° F., such as, for example, 500-1500° F., 1000-2000° F., 1500° F.-2000° F., or 2000-2500° F., to form the surface coating. In certain non-limiting embodiments, the inorganic fibers, such as glass blankets and glass tapes, may be heated to a temperature from 2000-2500° F. In certain non-limiting embodiments, the inorganic particles, such as glass particles, may be heated to a temperature from 1500-2000° F. In certain non-limiting embodiments, the temperature may be greater than the melting point of the inorganic material. In certain non-limiting embodiments, the temperature may be greater than the temperature rating of the inorganic material. In various non-limiting embodiments, the temperature may be greater than the melting point of the glass fabric, glass particle, and/or glass tape. In one non-limiting embodiment, the temperature may be greater than the melting point of the glass blanket. As understood by a person skilled in the art, inorganic materials may not have a specific melting point and may be characterized by a "softening point". ASTM Test Method C338-93 (2008), for example, provides a standard test method for determining the softening point of a glass. As such, in certain non-limiting embodiments, the inorganic material may be heated to a temperature that is at least the softening point of the inorganic material.

In certain non-limiting embodiments, the surface coating may be formed on at least a portion of the surface of the alloy workpiece. In certain non-limiting embodiments, the surface coating may be formed on a substantial portion of the surface of the workpiece. In certain non-limiting embodiments, the surface coating may completely cover the surface of the workpiece. In certain non-limiting embodiments, the surface coating may be formed on a circumferential surface of the alloy workpiece. In certain non-limiting embodiments, the surface coating may be formed on a circumferential surface of the workpiece and at least one lateral face of the workpiece. In certain non-limiting embodiments, the surface coating may be formed on a circumferential surface of the workpiece and each lateral face of the workpiece. In certain non-limiting embodiments, the surface coating may be formed on at least a portion of the surface of the workpiece free from the inorganic material. For example, the inorganic material may be deposited onto a portion of the surface of the workpiece. The inorganic material may melt when heated. The melted inorganic material may flow to a portion of the surface of the workpiece on which the inorganic material was not deposited.

The inorganic material may be deposited to a thickness sufficient to form a surface coating thereon when heated, wherein the surface coating insulates the underlying workpiece surface from the surface of a contacting die, thereby inhibiting or preventing the underlying workpiece surface from cooling to a temperature at which the underlying workpiece surface may more readily crack during hot working. In this manner, greater hot working temperatures may generally correlate with a preference for greater surface coating thicknesses. In certain non-limiting embodiments, the surface coating may have a thickness suitable to reduce heat loss from the workpiece. In certain non-limiting embodiments, the surface coating may have a thickness of 0.1 mm to 2 mm, such as, for example, 0.5 mm to 1.5 mm, and about 1 mm. Without intending to be bound to any particular theory, the surface coating may reduce heat loss of the alloy workpiece and/or increase slippage of the workpiece relative to the die or other contacting surfaces during hot working. The surface coating may act as a thermal barrier to heat loss from the workpiece through convection, conduction, and/or radiation. In certain non-limiting embodiments, the surface coating may reduce surface friction of the alloy workpiece and act as a lubricant, and thereby increase the slippage of the workpiece during a hot working operation, e.g., forging and extruding. In certain non-limiting embodiments, the inorganic material may be deposited to a thickness sufficient to lubricate the workpiece during hot working operations.

According to certain non-limiting embodiments, a method of processing an alloy ingot or other alloy workpiece to reduce thermal cracking may generally comprise cooling the workpiece including the surface coating. Cooling the workpiece may comprise cooling the surface coating. In certain non-limiting embodiments, cooling the workpiece may comprise air cooling the workpiece. In certain non-limiting embodiments, cooling the workpiece may comprise disposing a ceramic blanket, such as, for example, a KAOWOOL blanket, onto at least one of the surface coating and at least a portion of a surface of the workpiece. In certain non-limiting embodiments, the surface of the workpiece may be cooled to room temperature.

According to certain non-limiting embodiments, a method of processing an alloy ingot or other alloy workpiece to reduce thermal cracking may generally comprise removing at least one of at least a portion of the surface coating and/or remnants of the surface coating from the workpiece. In certain non-limiting embodiments, the method may comprise, after hot working, removing at least one of a portion of the surface coating and/or remnants of the surface coating from the product formed by hot working the workpiece. Removing the surface coating or remnants may comprise, for example, one or more of shot blasting, grinding, peeling, and turning. In certain non-limiting embodiments, peeling the hot worked workpiece may comprise lathe-turning.

After initial workpiece formation, but before depositing the inorganic material and/or subsequent to hot working of the alloy workpiece, a non-limiting method of processing an alloy ingot or other alloy workpiece to reduce thermal cracking may generally comprise heating the workpiece and/or conditioning the surface of the workpiece. In certain non-limiting embodiments, an alloy workpiece may be exposed to high temperatures to homogenize the alloy composition and microstructure of the workpiece. The high temperatures may be above the recrystallization temperature of the alloy but below the melting point temperature of the alloy. For example, the workpiece may be heated to a forging temperature, the inorganic material may be deposited thereon, and the workpiece may be reheated to form a surface coating thereon. The workpiece may be heated before depositing the inorganic material to reduce the furnace time necessary to bring the workpiece to temperature. An alloy workpiece may be surface conditioned, for example, by grinding and/or peeling the surface of the workpiece. A workpiece may also be sanded and/or buffed. Surface conditioning operations may be performed before and/or after any optional heat treatment steps, such as, for example, homogenization at high temperatures.

According to certain non-limiting embodiments, a method of processing an alloy ingot or other alloy workpiece to reduce thermal cracking may generally comprise hot working the workpiece. Hot working the workpiece may comprise applying a force to the workpiece to deform the workpiece. The force may be applied with, for example, dies and/or rolls. In certain non-limiting embodiments, hot working the workpiece may comprise hot working the workpiece at a temperature from 1500° F. to 2500° F. In certain non-limiting embodiments, hot working the workpiece may comprise a forging operation and/or an extrusion operation. For example, a workpiece having a surface coating deposited onto at least a region of a surface of the workpiece may be upset forged and/or draw forged. In various non-limiting embodiments, the method may comprise after forming a surface coating on the workpiece, hot working the workpiece by forging. In various non-limiting embodiments, the method may comprise after forming a surface coating on the workpiece, hot working the workpiece by forging at a temperature from 1500° F. to 2500° F. In various non-limiting embodiments, the method may comprise after forming a surface coating on the workpiece, hot working the workpiece by extruding. In various non-limiting embodiments, the method may comprise after forming a surface coating on the workpiece, hot working the workpiece by extruding at a temperature from 1500° F. to 2500° F.

An upset-and-draw forging operation may comprise one or more sequences of an upset forging operation and one or more sequences of a draw forging operation. During an upset operation, the end surfaces of a workpiece may be in contact with forging dies that apply force to the workpiece that compresses the length of the workpiece and increases the cross-section of the workpiece. During a draw operation, the side surfaces (e.g., the circumferential surface of a cylindrical workpiece) may be in contact with forging dies that apply force to the workpiece that compresses the cross-section of the workpiece and increases the length of the workpiece.

In various non-limiting embodiments, an alloy ingot or other alloy workpiece having a surface coating deposited onto at least a region of a surface of the workpiece may be subjected to one or more upset-and-draw forging operations. For example, in a triple upset-and-draw forging operation, a workpiece may be first upset forged and then draw forged. The upset and draw sequence may be repeated twice more for a total of three sequential upset and draw forging operations. In various non-limiting embodiments, a workpiece having a surface coating deposited onto at least a region of a surface of the workpiece may be subjected to one or more extrusion operations. For example, in an extrusion operation, a cylindrical workpiece may be forced through a circular die, thereby decreasing the diameter and increasing the length of the workpiece. Other hot working techniques will be apparent to those having ordinary skill, and the methods according to the present disclosure may be adapted for use with one or more of such other techniques without the need for undue experimentation.

In various non-limiting embodiments, the methods disclosed herein may be used to produce a wrought billet from an alloy ingot on the form of a cast, consolidated, or spray formed ingot. The forge conversion or extrusion conversion of an ingot to a billet or other worked article may produce a finer grain structure in the article as compared to the former workpiece. The methods and processes described herein may improve the yield of forged or extruded products (such as, for example, billets) from workpieces because the surface coating may reduce the incidence of surface cracking of the workpiece during the forging and/or extrusion operations. For example, it has been observed that a surface coating according to the present disclosure provided on at least a region of a surface of a workpiece may more readily tolerate the strain induced by working dies. It also has been observed that a surface coating according to the present disclosure provided onto at least a portion of a surface of an alloy workpiece may also more readily tolerate the temperature differential between the working dies and the workpiece during hot working. In this manner, it has been observed that a surface coating according to the present disclosure may exhibit zero or minor surface cracking while surface crack initiation is prevented or reduced in the underlying workpiece during working.

In various non-limiting embodiments, ingot or other workpieces of various alloys having a surface coating according to the present disclosure may be hot worked to form products that may be used to fabricate various articles. For example, the processes described herein may be used to form billets from a nickel base alloy, an iron base alloy, a nickel-iron base alloy, a titanium base alloy, a titanium-nickel base alloy, a cobalt base alloy, a nickel base superalloy, and other superalloys. Billets or other products formed from hot worked ingots or other alloy workpieces may be used to fabricate articles including, but not limited to, turbine components, such as, for example, disks and rings for turbine engines and various land-based turbines. Other articles fabricated from alloy ingots or other alloy workpieces processed according to various non-limiting embodiments described herein may include, but are not limited to, valves, engine components, shafts, and fasteners.

Alloy workpieces that may be processed according to the various embodiments herein may be in any suitable form. In particular non-limiting embodiments, for example, the alloy workpieces may comprise or be in the form of ingots, billets, bars, plates, tubes, sintered pre-forms, and the like.

The various non-limiting embodiments described herein may be better understood when read in conjunction with the following representative examples. The following examples are included for purposes of illustration and not limitation.

EXAMPLE 1

Figure 2:
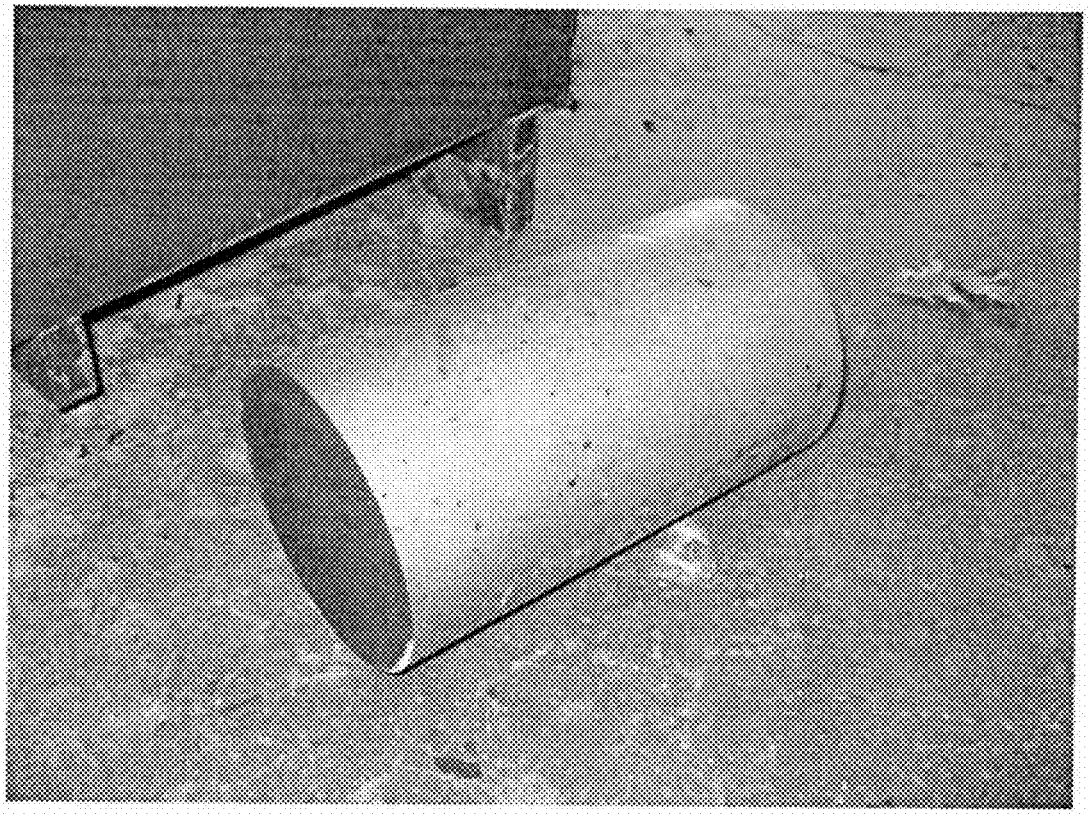
FIG. 2 is a photograph of an alloy workpiece according to a non-limiting embodiment disclosed herein.
Figure 3:
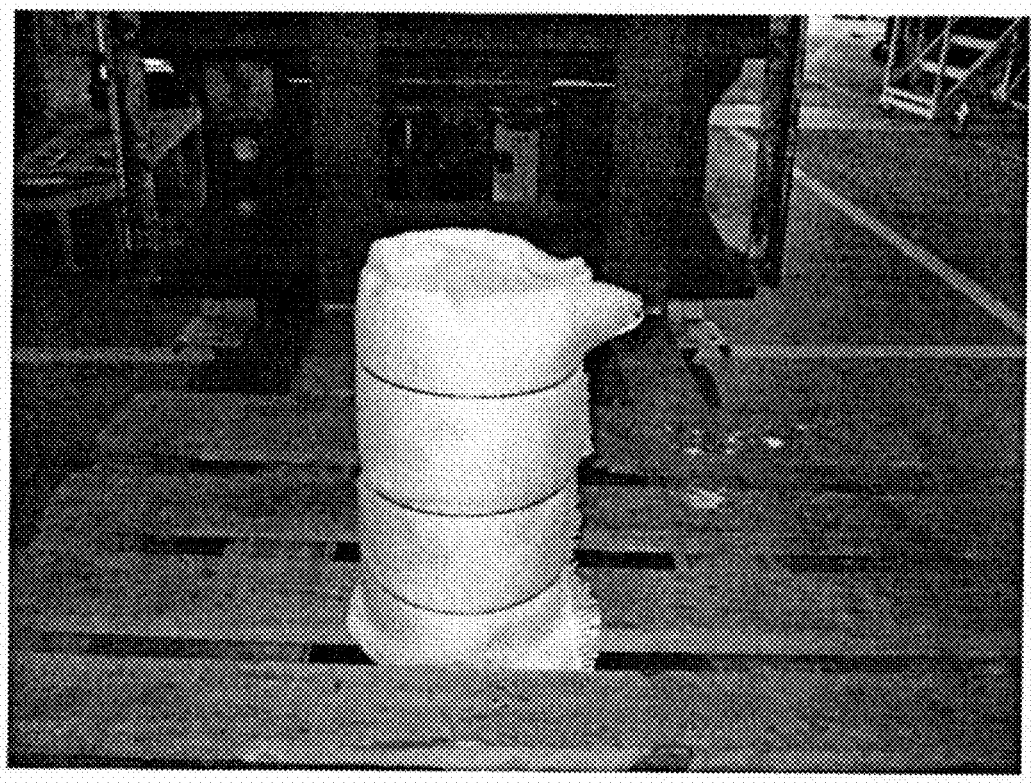
FIG. 3 is a photograph of the workpiece of FIG. 2 comprising a fiberglass blanket disposed thereon according to a non-limiting embodiment disclosed herein.
Figure 4:
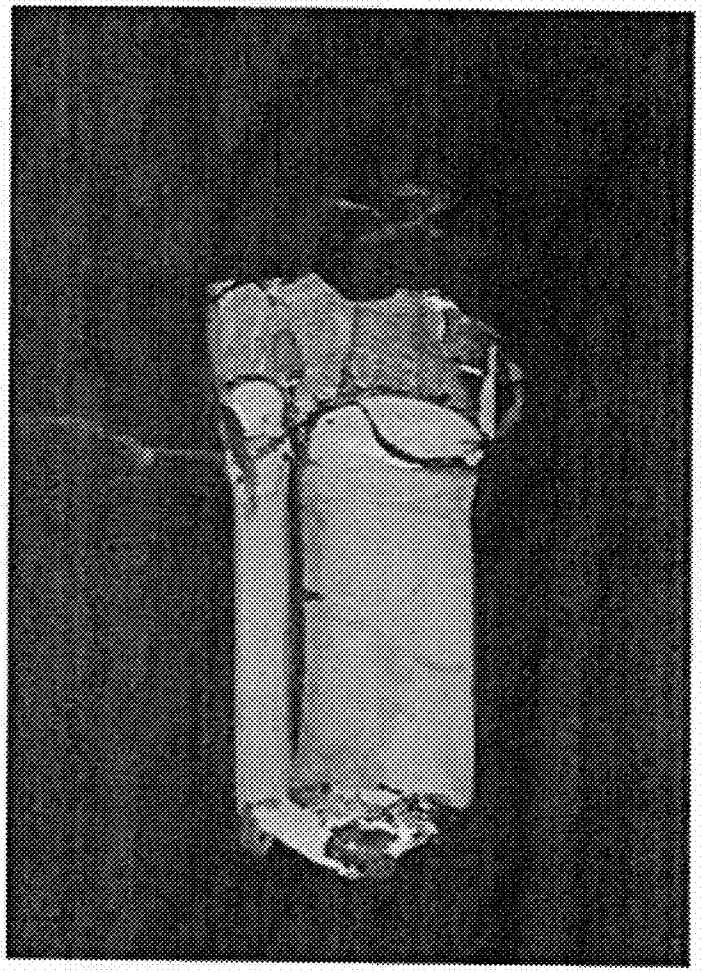
FIG. 4 is a photograph of the alloy workpiece of FIG. 3 comprising a surface coating thereon reducing heat loss from the workpiece according to a non-limiting embodiment disclosed herein, wherein the workpiece has been hot worked.

Referring to FIGS. 2-8, in certain non-limiting embodiments according to the present disclosure, the alloy workpiece may comprise a cylindrical alloy ingot. Two generally cylindrical workpieces in form of ingots having a length of 10⅜ inches and a width of 6 inches, as generally shown in FIG. 2, were heat treated at 2100° F. for 3 hours. Each workpiece was wrapped in a KAOWOOL ceramic blanket and allowed to cool. The KAOWOOL ceramic blanket was removed. One workpiece was wrapped in a double layer of an E-glass blanket, as shown in FIG. 3. The E-glass blanket was secured to the workpiece using bale wire. An inorganic slurry comprising ATP-610 material (available from Advanced Technical Products, Cincinnati, Ohio) was brushed onto the outer surface of the blanket. The second workpiece was not covered with any material. Each of the two workpieces was placed in a 2040° F. furnace for about 17 hours. Each workpiece was then forged at temperature to a workpiece with a 5 inch by 4.5 inch cross-section. FIG. 4 is a photograph of the workpiece comprising the surface coating during forging.

Figure 5:
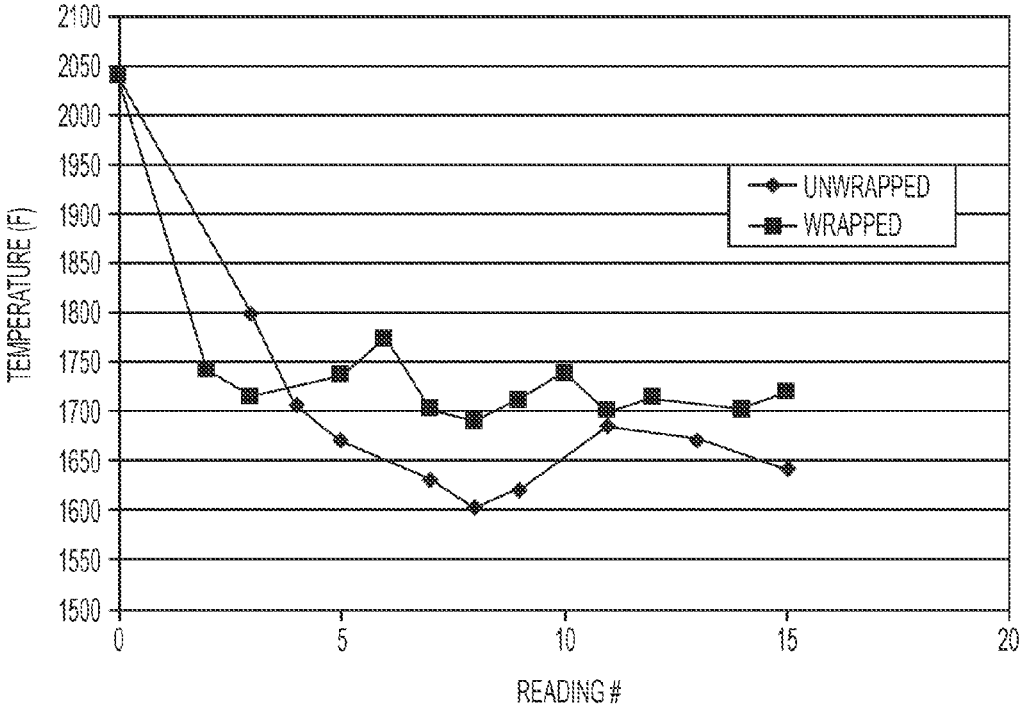
FIG. 5 is a chart plotting surface temperature over time during forging of an alloy workpiece lacking a surface coating shown in FIGS. 6 and 7 and during forging of the workpiece including a surface coating shown of FIGS. 6 and 7.
Figure 6:
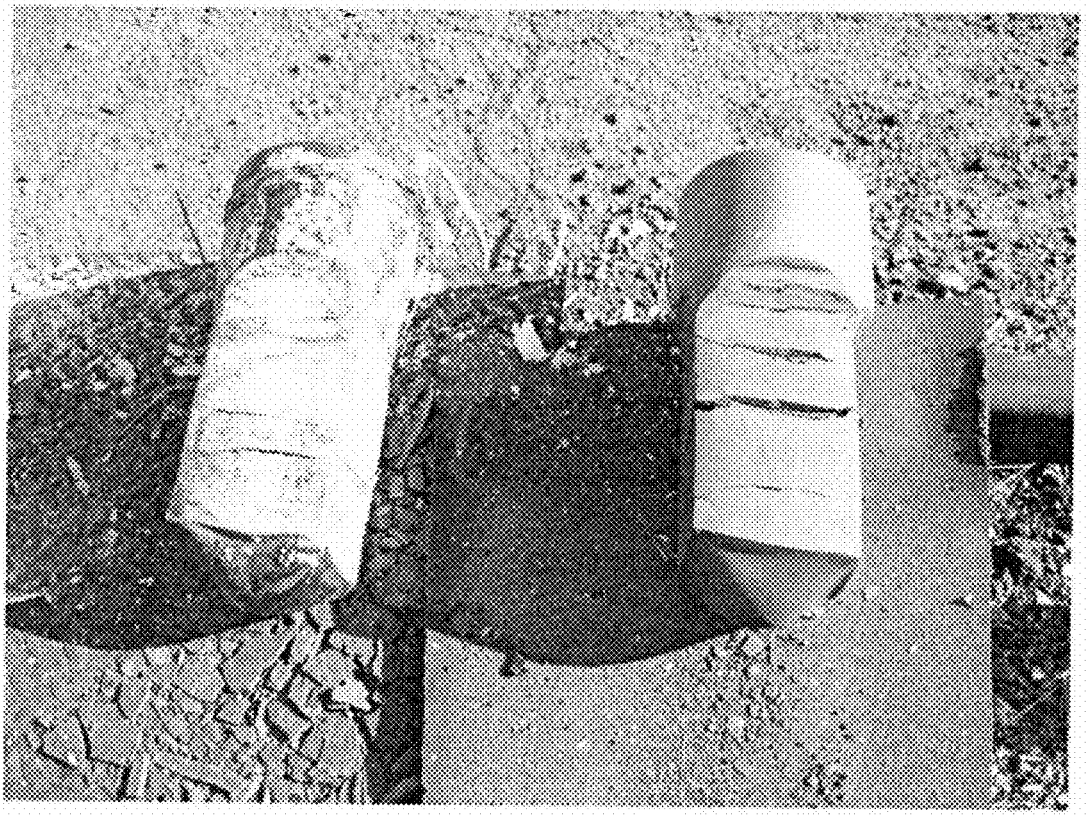
FIGS. 6 and 7 are photographs of a forged alloy workpiece lacking a surface coating (the workpiece on the right in each photograph) and the forged workpiece of FIG. 4 including a surface coating (the workpiece on the left in each photograph).
Figure 7:
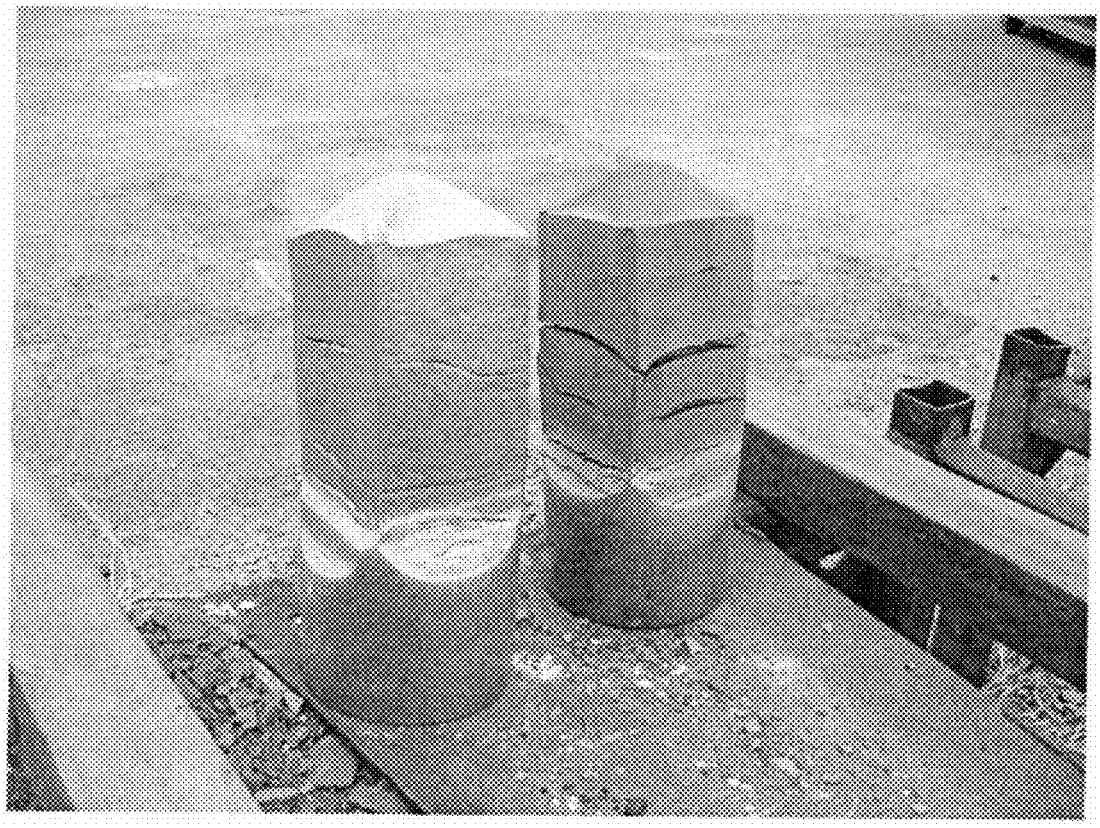

FIG. 5 plots workpiece surface temperature over time during forging of the coated and uncoated workpieces. As shown in FIG. 5, the surface temperature of the coated workpiece ("Wrapped") during forging was generally about 50° C. higher than for the uncoated workpiece ("Unwrapped"). The surface temperature was measured using an infrared pyrometer. FIGS. 6 and 7 are photographs of the forged coated workpiece (on the left in both photographs) and the forged uncoated workpiece (on the right in both photographs). In FIG. 6, solidified remnants of the surface coating are visible on the surface of the coated workpiece. While FIG. 7 shows the coated workpiece after the remnants of the coating have been removed by shot blasting. Consideration of FIGS. 6 and 7 shows that although the forged coated workpiece shows some cracking, the incidence of severity of cracking was significantly less than for the forged uncoated workpiece. Cracking on the forged coated workpiece occurred where the E-glass blanket was secured to the workpiece by the bale wire, and it is believed that the bale wire may have applied stress to the workpiece when the forging force was applied, which may have lead to formation of the cracks. The higher crack sensitivity of the forged workpiece lacking the surface coating is visible on the surface.

EXAMPLE 2

Figure 8:
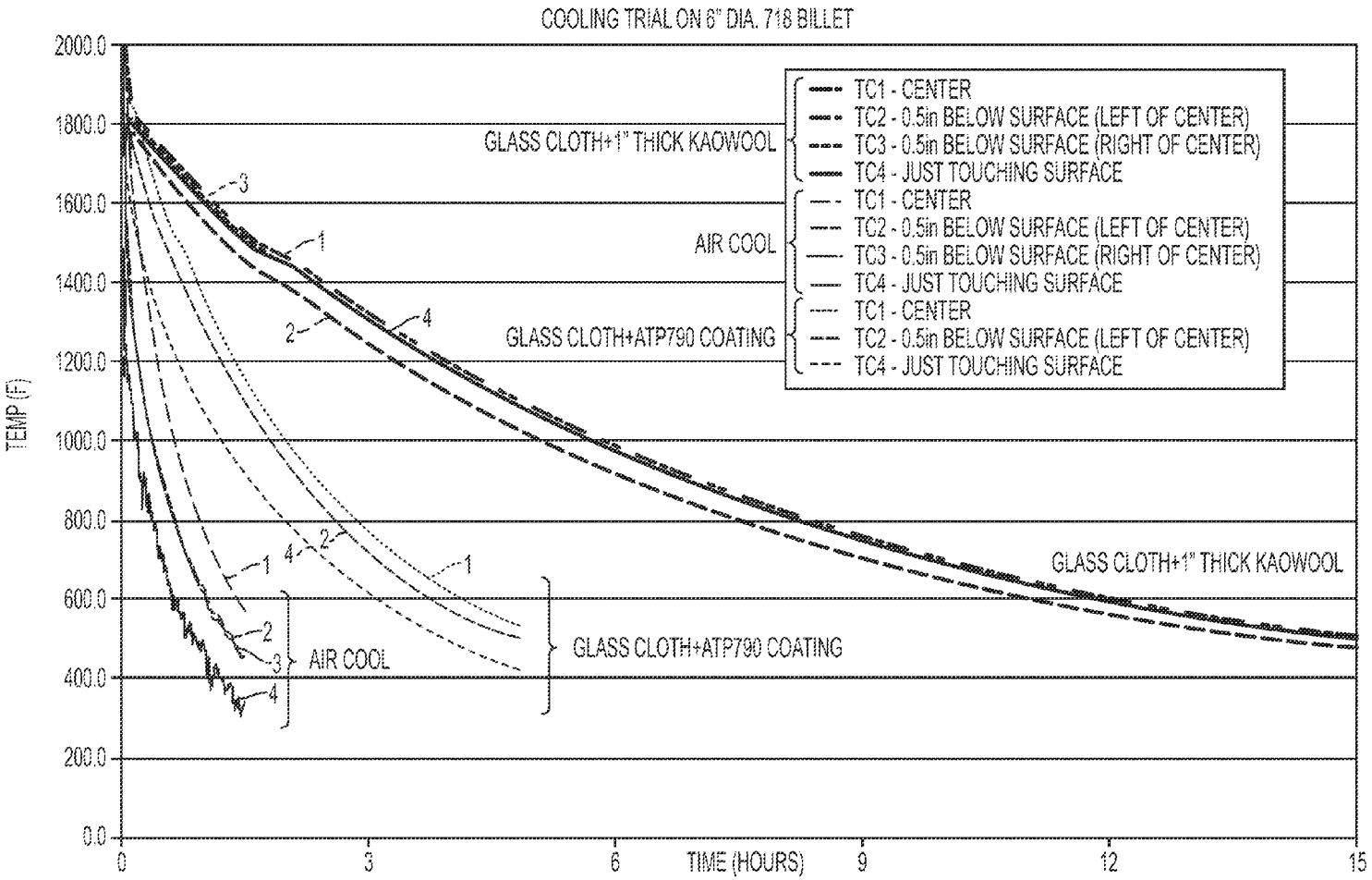
FIG. 8 is a chart plotting temperature over time during cooling of an alloy workpiece lacking a surface coating ("AIR COOL") and alloy workpieces including surface coatings thereon according to non-limiting embodiments disclosed herein.

FIG. 8 is a chart plotting temperature over time during cooling of three 6 inch diameter Alloy 718 ingot workpieces during a forging operation. Each workpiece was allowed to cool in ambient air. Each workpiece's temperature was measured using embedded thermocouples. The temperature was assessed at the following positions on each workpiece: on the surface of the center of the workpiece; 0.5 inches below the surface on a left region of the workpiece; and 0.5 inches below the surface on a right region of the workpiece. A first one of the three workpieces was wrapped in an E-glass blanket secured to the workpiece using bale wire. An inorganic slurry comprising ATP-790 material (available from Advanced Technical Products, Cincinnati, Ohio) was brushed onto the outer surface of the E-glass blanket. A portion of the surface of a second workpiece was wrapped in an E-glass blanket and a 1 inch thick KAOWOOL ceramic blanket. The third workpiece was left uncovered. The workpieces were heated to a forging temperature, and E-glass blanket/inorganic slurry and E-glass blanket/KAOWOOL blanket on the first and second workpiece, respectively, formed a surface coating on the workpieces that adhered to the workpieces' surfaces.

Figure 9:
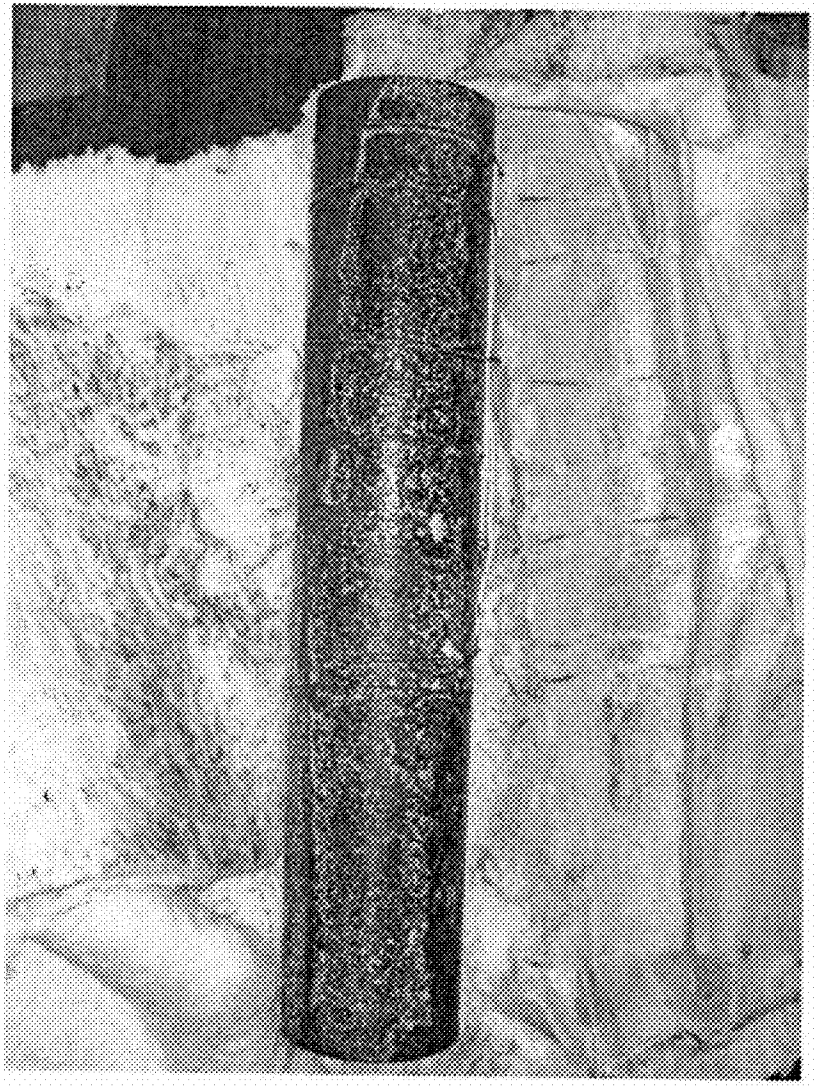
FIG. 9 is a photograph of an alloy workpiece including a surface coating thereon according to a non-limiting embodiment disclosed herein.

As shown in FIG. 8, the presence of the surface coatings significantly decreased the cooling rates of the coated workpieces. It is believed that decreasing the cooling rate may reduce the incidence of surface cracking in the workpiece during forging, extrusion, or other hot working operations. The workpiece without a surface coating cooled significantly faster than the workpieces comprising a surface coating. The uncoated workpiece cooled from the forging temperature (approx. 1950° F.) down to 300° F. to 600° F. (depending on the temperature measurement location) over a period of less than 3 hours. FIG. 9 is a photograph of the workpiece comprising the E-glass blanket/KAOWOOL surface coating. The workpiece comprising the E-glass blanket/ATP-790 inorganic slurry surface coating cooled faster than the workpiece comprising the E-glass blanket/ceramic blanket surface coating. The workpiece comprising the E-glass blanket/ATP-790 inorganic slurry surface cooled from the forging temperature down to 400° F. to 600° F. (depending on the temperature measurement location) over a period of about 5 to 6 hours. The workpiece comprising the E-glass blanket/ceramic blanket surface coating cooled form the forging temperature down to 400° F. to 600° F. over a period exceeding 12 hours.

EXAMPLE 3

Figure 10:
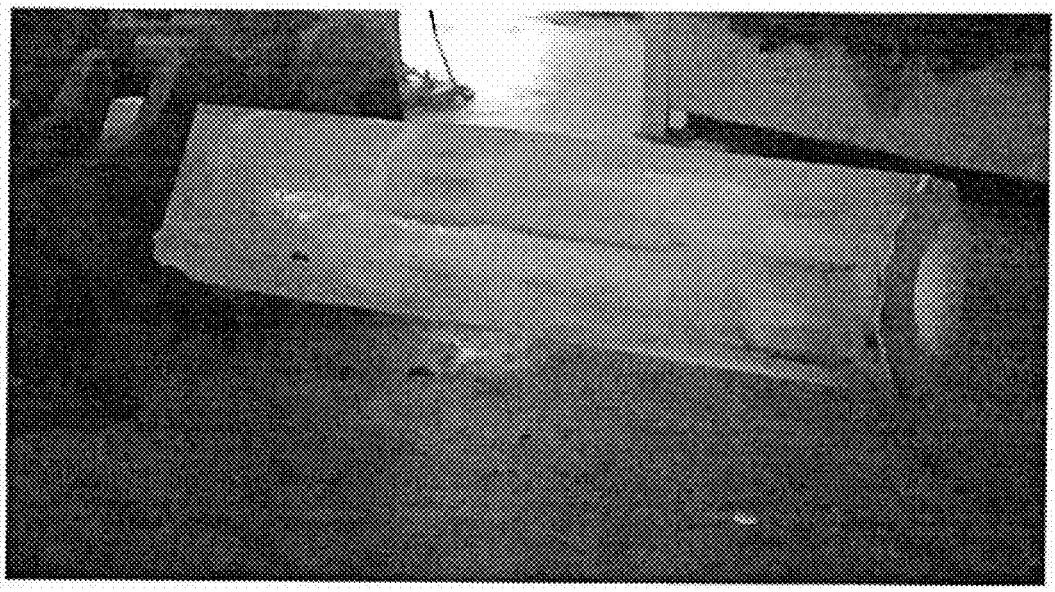
FIG. 10 is a photograph of a hot forged alloy workpiece comprising a portion lacking a surface coating and a portion including a surface coating thereon according to a non-limiting embodiment disclosed herein.
Figure 11:
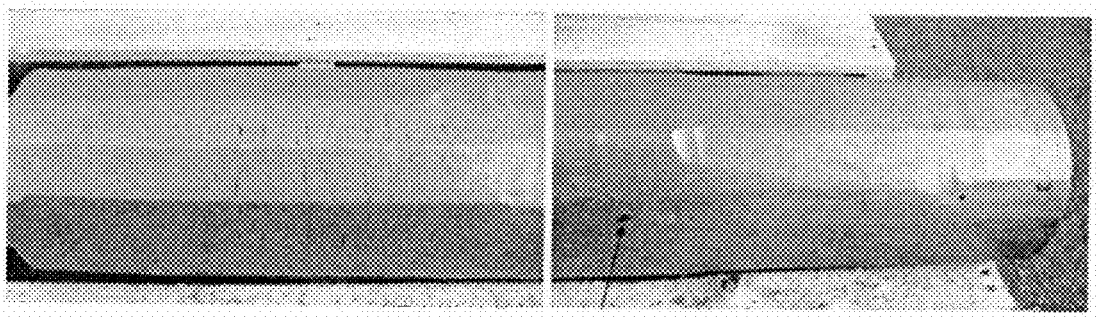
FIG. 11 is a photograph of regions of the workpiece of FIG. 10 after removing at least a portion of the surface coating from the workpiece.

An alloy workpiece in the form of a generally cylindrical uncoated ingot of 718Plus® alloy (UNS No. N07818) was hot forged from a diameter of 20 inches down to a diameter of 14 inches. The workpiece developed extensive surface cracks during the forging operation. The forged workpiece was turned down to 12 inches diameter to remove the surface cracks. The turned workpiece was then hot forged from 12 inches to 10 inches, and one end of the workpiece cracked extensively during forging. The workpiece was then surface conditioned by shot blasting and a first end of the workpiece was hot forged from 10 inches to 6 inches. An E-glass blanket was wrapped around and secured to the second end of the forged workpiece, and the workpiece was placed in a furnace at a temperature of 1950° F. and heated. The E-glass blanket formed a surface coating on the second end when heated. FIG. 10 is a photograph of the partially forged and partially coated workpiece after the workpiece was removed from the furnace. The end comprising the surface coating was forged from 12 inches down to 6 inches, allowed to cool, and then shot blasted to remove the surface coating. The surface coating adhered to the surface of the second end of the workpiece during the forging operation, reducing heat loss from the second end. FIG. 11 is a photograph showing the forged uncoated end of the workpiece (left photograph) and the forged coated end of the workpiece (right photograph) after shot blasting. The black spots on the surface of the forged coated workpiece after shot blasting are remnants of the surface coating. The significant incidence of surface cracking resulting from forging is evident in the photograph of the forged uncoated workpiece in FIG. 11. In contrast, the significant reduction in the incidence of cracking (i.e., the significantly reduced crack sensitivity) of the coated workpiece end is evident from the photograph of the forged coated workpiece in FIG. 11. Thus, it is believed that the inorganic coating significantly reduced the incidence of surface cracking during forging.

EXAMPLE 4

Figure 12:
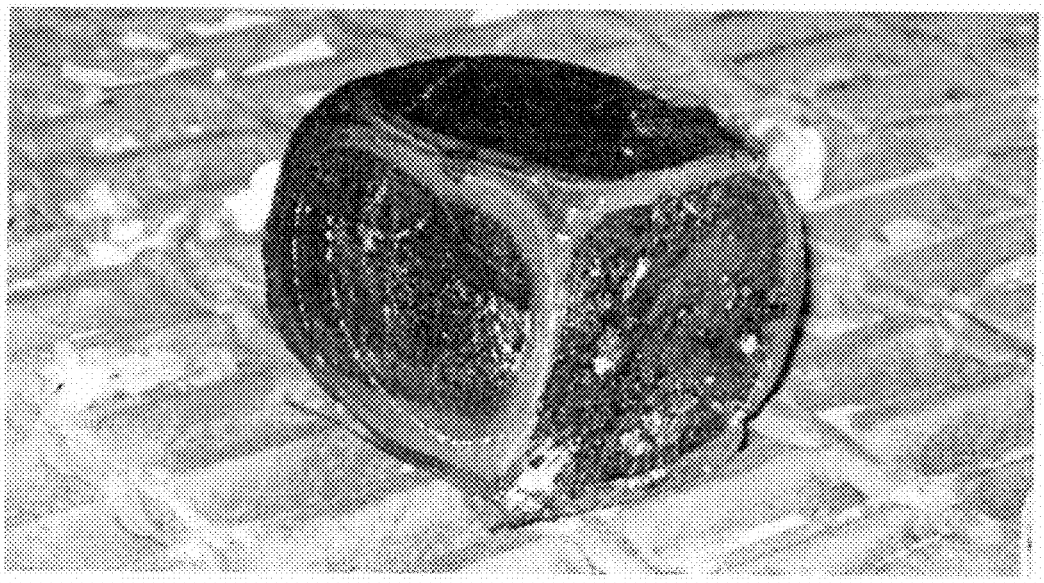
FIG. 12 is a photograph of an alloy workpiece having a surface coating thereon according to a non-limiting embodiment disclosed herein.

An alloy workpiece in the form of a 1.5 inch diameter generally cylindrical titanium Ti-6Al-4V alloy (UNS No. R56400) ingot was heated in a furnace at a temperature of 1500° F. for 1.5 hours. The heated workpiece was rolled in glass particles comprising Oxylub-327 material (available from Advance Technical Products, Cincinnati, Ohio), which has a metal hot-working range of 1400-1850° F. The workpiece was then placed in the furnace for an additional 30 minutes, and the glass particles formed a surface coating on the workpiece during the heating operation. The coated workpiece was then forged three times in three independent directions. FIG. 12 is a photograph of the workpiece after forging, and the adherent surface coating is evident in the photograph. The surface coating adhered to the surface of the workpiece during the forging operation and reduced heat loss from the workpiece.

All documents cited in herein are incorporated herein by reference unless otherwise indicated. The citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular non-limiting embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of processing an alloy workpiece to reduce thermal cracking, the method comprising:

disposing a glass fabric directly onto at least a portion of a surface of an alloy workpiece;

depositing glass particles onto at least a portion of the glass fabric; and heating the glass materials to form a surface coating on the alloy workpiece that reduces heat loss from the alloy workpiece.

2. The method of claim 1, wherein the glass fabric comprises a glass fiber fabric.

3. The method of claim 1, wherein:

the glass fabric is an E-glass fabric having a temperature rating from 1000° F. to 2100° F.

4. The method of claim 3, wherein disposing the E-glass fabric onto at least a portion of a surface of the alloy workpiece comprises disposing the E-glass fabric on at least a portion of a circumferential surface of the alloy workpiece.

5. The method of claim 3, wherein disposing the E-glass fabric onto at least a portion of a surface of the alloy workpiece comprises disposing the E-glass fabric on at least a portion of a circumferential surface of the alloy workpiece and at least one lateral face of the alloy workpiece.

6. The method of claim 1, wherein:

depositing the glass particles comprises at least one of spraying, brushing, flow coating, sprinkling, rolling, and dipping.

7. The method of claim 1, comprising heating the glass materials to a temperature from 1000° F. to 2200° F.

8. The method of claim 1, further comprising, prior to depositing the glass materials:

heating the alloy workpiece to a forging temperature.

9. The method of claim 1, further comprising, prior to depositing the glass materials:

heating the alloy workpiece to a forging temperature; and conditioning a surface of the alloy workpiece.

10. The method of claim 1, further comprising cooling the alloy workpiece.

11. The method of claim 1, further comprising removing at least a portion of the surface coating from the alloy workpiece by at least one of shot blasting, grinding, peeling, and turning the alloy workpiece.

12. The method of claim 1, wherein the alloy workpiece comprises a material selected from the group consisting of a nickel base alloy, a nickel base superalloy, an iron base alloy, a nickel-iron base alloy, a titanium base alloy, a titanium-nickel base alloy, and a cobalt base alloy.

13. The method of claim 1, wherein the alloy workpiece comprises a material selected from the group consisting of Alloy 718 (UNS No. N07718), Alloy 720 (UNS No. N07720), Rene 41™ alloy (UNS No. N07041), Rene 88™ alloy, Waspaloy® alloy (UNS No. N07001), and Inconel® 100 alloy.

14. The method of claim 1, wherein the alloy workpiece comprises one of an ingot, a billet, a bar, a plate, a tube, and a sintered pre-form.

15. The method of claim 1, wherein the alloy workpiece comprises a nickel base superalloy and the glass fabric comprises an E-glass fabric.

16. The method of claim 1, further comprising, after heating the glass materials to form a surface coating on the alloy workpiece, applying force with at least one of a die and a roll to the alloy workpiece to deform the alloy workpiece.

17. The method of claim 1, further comprising, after forming a surface coating on the alloy workpiece, hot working the alloy workpiece.

18. The method of claim 17, wherein the alloy workpiece is hot worked at a temperature from 1500° F. to 2500° F.

19. The method of claim 18, further comprising:

fabricating an article from the hot worked workpiece, the article selected from the group consisting of a jet engine component, a land based turbine component, valves, engine components, shafts, and fasteners.

20. The method of claim 1, further comprising, after forming a surface coating on the alloy workpiece, hot working the alloy workpiece by forging.

21. The method of claim 20, wherein the alloy workpiece is hot worked at a temperature from 1500° F. to 2500° F.

22. The method of claim 20, wherein the alloy workpiece comprises one of an ingot, a billet, a bar, a plate, a tube, and a sintered pre-form.

23. The method of claim 1, further comprising, after forming a surface coating on the workpiece, hot working the workpiece by extruding.

24. A method of processing an alloy workpiece, the alloy workpiece comprising a material selected from the group consisting of a nickel base alloy, a nickel base superalloy, an iron base alloy, a nickel-iron base alloy, a titanium base alloy, a titanium-nickel base alloy, and a cobalt base alloy, the method comprising:

disposing a glass fabric directly onto at least a portion of a surface of an alloy workpiece;

depositing glass particles onto at least a portion of the glass fabric;

heating the glass materials to form a surface coating on the alloy workpiece that reduces heat loss from the alloy workpiece; and hot working the alloy workpiece.

25. The method of claim 24, wherein the alloy workpiece comprises a material selected from the group consisting of Alloy 718 (UNS No. N07718), Alloy 720 (UNS No. N07720), Rene 41™ alloy (UNS No. N07041), Rene 88™ alloy, Waspaloy™ alloy (UNS No. N07001), and Inconel® 100 alloy.

26. The method of claim 24, wherein the alloy workpiece comprises one of an ingot, a billet, a bar, a plate, a tube, and a sintered pre-form.

27. The method of claim 24, wherein hot working the alloy workpiece comprises forging the alloy workpiece.

28. The method of claim 24, wherein hot working the alloy workpiece comprises extruding the alloy workpiece.

29. The method of claim 24, further comprising:

removing at least a portion of the surface coating from the alloy workpiece.

30. A method of hot working an alloy workpiece, the method comprising:

disposing a fiberglass blanket onto at least a portion of a surface of an alloy workpiece;

depositing glass particles onto at least a portion of the fiberglass blanket;

heating the fiberglass blanket and the glass particles to form a surface coating on the alloy workpiece; and applying a force with at least one of a die and a roll to the alloy workpiece to deform the alloy workpiece;

wherein the at least one of a die and a roll contacts the surface coating on a surface of the alloy workpiece.

31. The method of claim 30, wherein the alloy workpiece comprises a material selected from the group consisting of a nickel base alloy, a nickel base superalloy, an iron base alloy, a nickel-iron base alloy, a titanium base alloy, a titanium-nickel base alloy, and a cobalt base alloy.

32. The method of claim 30, wherein the alloy workpiece comprises a material selected from the group consisting of Alloy 718 (UNS No. N07718), Alloy 720 (UNS No. N07720), Rene 41™ alloy (UNS No. N07041), Rene 88™ alloy, Waspaloy® alloy (UNS No. N07001), and Inconel® 100 alloy.

33. The method of claim 30, wherein the alloy workpiece comprises one of an ingot, a billet, a bar, a plate, a tube, and a sintered pre-form.

34. The method of claim 30, wherein applying a force with at least one of a die and a roll to the alloy workpiece to deform the alloy comprises forging the alloy workpiece.

35. The method of claim 30, wherein applying a force with at least one of a die and a roll to the alloy workpiece to deform the alloy comprises extruding the alloy workpiece.

36. The method of claim 30, further comprising:

removing at least a portion of the surface coating from the alloy workpiece.

37. A method of processing an alloy workpiece comprising:

positioning a glass tape directly onto at least a portion of a surface of an alloy workpiece; and heating the glass tape to form a surface coating on the alloy workpiece.

38. A method of processing an alloy workpiece comprising:

positioning a fiberglass blanket directly onto at least a portion of a surface of an alloy workpiece;

positioning a ceramic blanket over the fiberglass blanket; and heating the blankets to form a surface coating on the alloy workpiece.

39. A method of processing an alloy workpiece comprising:

heating a cylindrical alloy workpiece to a temperature greater than 1000° F.;

rolling the heated cylindrical alloy workpiece in a bed of glass particles to deposit the glass particles on a cylindrical surface of the workpiece; and heating the cylindrical alloy workpiece and the deposited glass particles at a temperature greater than 1000° F. to form a surface coating on the alloy workpiece.

* * * * *